US009982213B2

(12) United States Patent
Kabata et al.

(10) Patent No.: US 9,982,213 B2
(45) **Date of Patent: *May 29, 2018**

(54) DRIVE DEVICE, IMAGE FORMING APPARATUS, AND GREASE COMPOSITION

(71) Applicants: Toshiyuki Kabata, Kanagawa (JP); Kumiko Seo, Kanagawa (JP); Masahiro Ishida, Kanagawa (JP); Naoki Matsuda, Kanagawa (JP); Teruyoshi Tanaka, Kanagawa (JP)

(72) Inventors: Toshiyuki Kabata, Kanagawa (JP); Kumiko Seo, Kanagawa (JP); Masahiro Ishida, Kanagawa (JP); Naoki Matsuda, Kanagawa (JP); Teruyoshi Tanaka, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 60 days.

This patent is subject to a terminal disclaimer.

(21) Appl. No.: 14/717,403

(22) Filed: May 20, 2015

(65) Prior Publication Data

US 2015/0344809 A1 Dec. 3, 2015

(30) Foreign Application Priority Data

May 29, 2014 (JP) ..... 2014-111495
Mar. 9, 2015 (JP) ..... 2015-045808

(51) Int. Cl.
*C10M 117/02* (2006.01)
*C10M 115/00* (2006.01)
(Continued)

(52) U.S. Cl.
CPC ..... *C10M 161/00* (2013.01); *B65H 3/0669* (2013.01); *C10M 117/04* (2013.01);
(Continued)

(58) Field of Classification Search
CPC ..... F16C 31/02; G11B 5/82; C10M 117/02
(Continued)

(56) References Cited

U.S. PATENT DOCUMENTS 2,846,394 A 8/1958 Brunstram et al.
3,003,962 A 10/1961 Jorden et al.
(Continued)

FOREIGN PATENT DOCUMENTS

CN 1534217 A 10/2004
CN 1821900 A 8/2006
(Continued)

OTHER PUBLICATIONS

Infineum SV150 Dissolving Guide, May 2007.*
(Continued)

*Primary Examiner* — Vishal Vasisth
(74) *Attorney, Agent, or Firm* — Harness, Dickey & Pierce, P.L.C.

(57) ABSTRACT

A drive device includes a plurality of gears; and a grease composition that is held on a tooth flank of at least one gear of the gears. The at least one gear is made of a resin. The grease composition contains a hydrocarbon base oil, lithium soap serving as a thickener, and olefin resin powder. A weight ratio between the hydrocarbon base oil and the lithium soap in the grease composition is in a range of 94.5:5.5 to 96.0:4.0. A consistency of the grease composition is in a range of 360 to 400.

12 Claims, 5 Drawing Sheets

(51) Int. Cl.

| | |
|---|---|
| ***F16H 55/17*** | (2006.01) |
| ***C10M 161/00*** | (2006.01) |
| ***B65H 3/06*** | (2006.01) |
| ***C10M 117/04*** | (2006.01) |

(52) U.S. Cl.
CPC ..... *B65H 2402/46* (2013.01); *B65H 2402/70* (2013.01); *B65H 2601/521* (2013.01); *C10M 2205/022* (2013.01); *C10M 2205/046* (2013.01); *C10M 2205/066* (2013.01); *C10M 2207/1245* (2013.01); *C10N 2210/01* (2013.01); *C10N 2220/022* (2013.01); *C10N 2230/76* (2013.01); *C10N 2240/04* (2013.01); *C10N 2240/06* (2013.01); *C10N 2240/203* (2013.01); *C10N 2250/10* (2013.01); *G03G 2221/1657* (2013.01)

(58) Field of Classification Search
USPC ..... 508/521
See application file for complete search history.

(56) References Cited

U.S. PATENT DOCUMENTS

| | | | | |
|---|---|---|---|---|
| 5,690,292 | A | 11/1997 | Sano | |
| 7,662,885 | B2 | 2/2010 | Coffey et al. | |
| 7,759,415 | B2 | 7/2010 | Coffey et al. | |
| 8,242,065 | B2 | 8/2012 | Sawaguchi et al. | |
| 9,061,698 | B2 | 6/2015 | Wakugawa et al. | |
| 2003/0022797 | A1 | 1/2003 | Oohira et al. | |
| 2003/0081351 | A1 | 5/2003 | Parsoneault et al. | |
| 2004/0248688 | A1 | 12/2004 | Shimada | |
| 2005/0069357 | A1 | 3/2005 | Kabata et al. | |
| 2006/0182474 | A1 | 8/2006 | Naito et al. | |
| 2006/0199896 | A1 | 9/2006 | Walton et al. | |
| 2006/0213303 | A1 | 9/2006 | Shigemi et al. | |
| 2006/0269323 | A1 | 11/2006 | Kabata et al. | |
| 2007/0110488 | A1 | 5/2007 | Kabata et al. | |
| 2007/0242910 | A1 | 10/2007 | Akita et al. | |
| 2008/0069635 | A1 | 3/2008 | Maehata et al. | |
| 2008/0089713 | A1 | 4/2008 | Ishida et al. | |
| 2008/0226344 | A1* | 9/2008 | Cha | G03G 15/757 399/167 |
| 2009/0182114 | A1 | 7/2009 | Kusaka et al. | |
| 2010/0197540 | A1 | 8/2010 | Shan et al. | |
| 2010/0239318 | A1 | 9/2010 | Maehata et al. | |
| 2011/0007990 | A1 | 1/2011 | Kawamura | |
| 2011/0129270 | A1 | 6/2011 | Seo et al. | |
| 2011/0152139 | A1 | 6/2011 | Akita et al. | |
| 2011/0160105 | A1 | 6/2011 | Tanaka et al. | |
| 2011/0170892 | A1 | 7/2011 | Ishida et al. | |
| 2011/0306527 | A1 | 12/2011 | Bouffet et al. | |
| 2012/0060633 | A1 | 3/2012 | Ishida et al. | |
| 2012/0106881 | A1 | 5/2012 | Akita et al. | |
| 2012/0142566 | A1 | 6/2012 | Yamamoto | |
| 2014/0060484 | A1 | 3/2014 | Hiramoto et al. | |
| 2014/0119799 | A1 | 5/2014 | Kabata et al. | |
| 2014/0226927 | A1 | 8/2014 | Ishii et al. | |
| 2014/0239760 | A1* | 8/2014 | Asai | H02K 7/116 310/83 |
| 2015/0060191 | A1 | 3/2015 | Matsuda et al. | |
| 2015/0110517 | A1 | 4/2015 | Ishida et al. | |
| 2015/0344809 | A1 | 12/2015 | Kabata et al. | |

FOREIGN PATENT DOCUMENTS

| | | | |
|---|---|---|---|
| CN | 1837651 | A | 9/2006 |
| CN | 101213244 | A | 7/2008 |
| CN | 101990569 | A | 3/2011 |
| CN | 102134523 | A | 7/2011 |
| CN | 102348790 | A | 2/2012 |
| CN | 102471718 | A | 5/2012 |
| CN | 103045334 | A | 4/2013 |
| CN | 103727216 | A | 4/2014 |
| EP | 1806512 | A1 | 7/2007 |
| JP | 0917148 | | 1/1997 |
| JP | 11-167234 | | 6/1999 |
| JP | 2001-089778 | A | 4/2001 |
| JP | 2001-228660 | | 8/2001 |
| JP | 2003-312868 | | 11/2003 |
| JP | 2004225809 | A | 8/2004 |
| JP | 2005-329849 | A | 12/2005 |
| JP | 2007-070461 | A | 3/2007 |
| JP | 2007297449 | A | 11/2007 |
| JP | 2008-031406 | | 2/2008 |
| JP | 2010-083658 | | 4/2010 |
| JP | 2011-148908 | | 8/2011 |
| JP | 5054668 | B2 | 10/2012 |
| JP | 2013185027 | A | 9/2013 |
| JP | 2013-234758 | A | 11/2013 |
| WO | WO-2010003918 | A1 | 1/2010 |
| WO | WO-2013/042715 | A1 | 3/2013 |

OTHER PUBLICATIONS

Extended European Search Report dated Oct. 2, 2015 issued in corresponding European Application No. 15169233.2.
European Search Report dated Oct. 13, 2015 for corresponding European Patent Application No. 15168740.7.
Chinese Office Action dated Feb. 17, 2017 for corresponding Chinese Patent Application No. 201510282249.0.
Chinese Office Action dated Jun. 16, 2017 for corresponding Chinese Patent Application No. 2015102826828.
Notice of Allowance dated May 30, 2017 for corresponding U.S. Appl. No. 14/715,784.
Non-Final Office Action dated Apr. 21, 2017 for corresponding U.S. Appl. No. 14/719,471.

* cited by examiner

DRIVE DEVICE, IMAGE FORMING APPARATUS, AND GREASE COMPOSITION

CROSS-REFERENCE TO RELATED APPLICATIONS

The present application claims priority to and incorporates by reference the entire contents of Japanese Patent Application No. 2014-111495 filed in Japan on May 29, 2014 and Japanese Patent Application No. 2015-045808 filed in Japan on Mar. 9, 2015.

BACKGROUND OF THE INVENTION

1. Field of the Invention

The present invention relates to a drive device and an image forming apparatus including a grease composition, and the grease composition used for the drive device and the image forming apparatus.

2. Description of the Related Art

Image forming apparatuses employing an electrophotographic process use many drive devices in mechanisms for an image reading process, an image forming process, a transfer process, and a paper conveyance process, for example. Conventional image forming apparatuses are large-sized and handled as precision apparatuses. The image forming apparatuses are, thus, often installed in places apart from people who perform office operations in offices such as dedicated rooms provide for the apparatuses. Sounds generated during the process for forming images by such image forming apparatuses, thus, are not a serious problem. In fact, the start of forming an image is checked by the generated sound and the end of forming the image is recognized by the stop of the sound.

With the progress of downsizing of the image forming apparatuses in recent years, cases have been increased in which the image forming apparatuses are installed in places just near users such as on the user's desks or side desks. A plurality of users often access an image forming apparatus through a local area network (LAN) to instruct the image forming apparatus to form an image using user's personal computers. As a result, the operating rate of the image forming apparatus tends to be increased. Sounds generated by the image forming apparatuses, which have not been a serious problem, can be often hard to bear for the users near the place in which the image forming apparatuses are installed. In addition, offices are quiet these days. Sounds generated from the image forming apparatuses, thus, become more noticeable.

Most of the generation sources of sounds from the image forming apparatuses are the drive devices described above. The drive devices drive objects by transmitting kinetic energy from the driving sources such as motors to the objects through gears and belts, for example. The image forming apparatuses each include many drive devices. In particular, the gears are very important parts for the transmission of the kinetic energy of the driving sources. Such a drive device is usually provided with many gears. In a sound generated from the drive devices, a noise generated due to rubbing between tooth flanks of the gears is very large.

As examples the image forming apparatuses that reduce a noise generated by rubbing between the tooth flanks of the gears, image forming apparatuses in Japanese Patent Application Laid-open No. 2010-083658 and Japanese Patent Application Laid-open No. 2003-312868 have been developed that reduce a noise by a grease composition applied on the tooth flanks of the gears. In Japanese Patent Application Laid-open No. 2001-228660, a drive device is disclosed that uses gears having grooves to hold a grease composition for preventing the grease composition from coming off from the tooth flanks. As examples such as the image forming apparatuses and the drive devices described above, conventionally, it has been common practice to apply a grease composition used for reducing a noise mainly on gears. It is considered that a slightly solid grease composition containing a solid lubricant such as polytetrafluoroethylene, molybdenum disulfide, or graphite has a high effect of reducing a noise. Such a grease composition prevents a hitting sound from being generated by a direct contact between the gears, and reduces friction and wear between the gears, thereby making it possible to maintain the smooth rotation of the gears. The reason why a slightly solid grease composition, specifically, a grease composition having a low consistency, is used is that an excessively soft grease composition may come off from the tooth flanks by a centrifugal force during the operation of the drive device.

SUMMARY OF THE INVENTION

Noise generated from a drive device includes noise due to rubbing between tooth flanks of gears that are engaged with each other and noise due to rubbing between a slide bearing and a shaft (shaft to which a gear is fixed) passing through the slide bearing. In addition, noise is also generated due to rubbing between a gear rotating on the peripheral surface of a shaft inserted through a hole thereof and the shaft inserted through the hole. The present inventors have found that most of slightly hard grease compositions prepared by blending the above-mentioned solid lubricant provide almost no effect on the noise due to the rubbing between the slide bearing and the shaft and the noise due to the rubbing between the inner peripheral surface of the hole of the gear and the shaft. What is even worse, some of such grease compositions provided between the slide bearing and the shaft and between the inner peripheral surface of the hole of the gear and the shaft worsen the noise. Most of the grease compositions that worsen the noise as described above reduce the noise due to the rubbing between the tooth flanks when they are applied on the tooth flanks of the gears. The phenomenon like this occurs for the following reason. That is that, a clearance between the slide bearing and the shaft passing through it and a clearance between the inner peripheral surface of the hole of the gear and the shaft passing through the hole are relatively small. Due to the small clearances, a large solid lubricant contained in the grease compositions is caught to the slide bearing or the shaft passing therethrough or caught to the inner peripheral surface of the hole of the gear or the shaft passing therethrough, thereby hindering the smooth rotation of the gears. As a result, a noise is generated.

To maintain a state of flow friction between the slide bearing and the shaft passing therethrough and between the inner peripheral surface of the hole of the gear and the shaft passing through the hole is preferable in view of the reduction of torque and noise.

Therefore, it is desirable that a soft grease composition is provided between the slide bearing and the shaft passing therethrough and between the inner peripheral surface of the hole of the gear and the shaft passing through the hole. On the other hand, the hard grease composition providing the effect conventionally as described above is applied to the tooth flanks of the gears that are engaged with each other desirably. These desires require attention so as to apply the grease compositions of the respective types to right targets with no mistake, resulting in lowered productivity of the drive device.

An object of the present invention is to provide a drive device, an image forming apparatus, and a grease composition that can prevent the lowering of productivity of the device, in the case where a noise due to rubbing between a slide bearing and a shaft passing therethrough and a noise due to rubbing between the inner peripheral surface of a hole of a gear and a shaft passing through the hole are reduced while the occurrence of a noise due to rubbing between tooth flanks of gears is reduced by a grease composition.

According to an embodiment, a drive device includes a plurality of gears; and a grease composition that is held on a tooth flank of at least one gear of the gears. The at least one gear is made of a resin. The grease composition contains a hydrocarbon base oil, lithium soap serving as a thickener, and olefin resin powder. A weight ratio between the hydrocarbon base oil and the lithium soap in the grease composition is in a range of 94.5:5.5 to 96.0:4.0. A consistency of the grease composition is in a range of 360 to 400.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

The following describes an embodiment of a drive device and an image forming apparatus according to the present invention.

First, experiments performed by the present inventors are described. The inventors have studied a reason why conventional grease compositions applied to tooth flanks of gears should be hard. As is already described, the conventional grease compositions applied to the tooth flanks of the gears contain a solid lubricant such as polytetrafluoroethylene, molybdenum disulfide, and graphite. These solid lubricants have a large specific gravity relative to base oil of the grease compositions and have inferior chemical affinity with the base oil. The solid lubricants are therefore difficult to be dispersed in the base oil in soft grease compositions and are easy to be separated from the base oil over time. Due to these characteristics, the soft grease compositions provide a small effect of reducing noise and are easy to cause scattering of the grease composition from the tooth flanks.

The inventors performed the following experiments.

Figure 1:
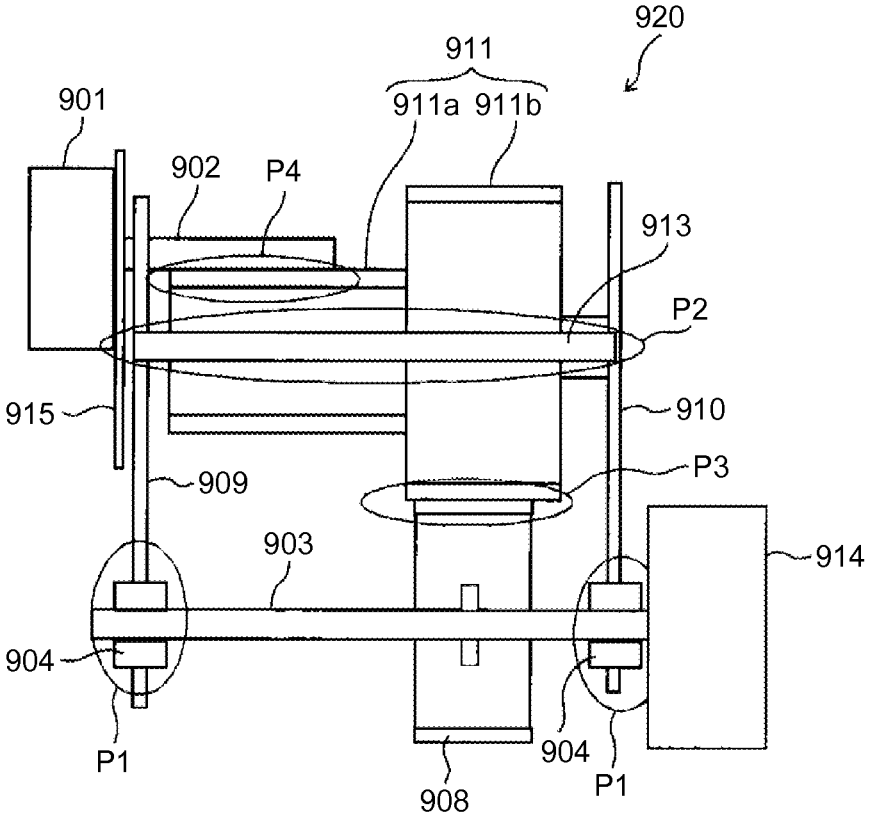
FIG. 1 is a main structural diagram illustrating a main part of a drive device according to an embodiment.

A test drive device 920 as illustrated in FIG. 1 was prepared. In the test drive device 920, slide bearings 904 are respectively provided on a first side plate 909 and a second side plate 910. A second gear 908 is fixed to a shaft 903 passing through these two slide bearings 904. A fixing shaft 913 bridged between the first side plate 909 and the second side plate 910 is unrotatably fixed thereto. The fixing shaft 913 passes through a first gear 911 having a through hole so as to rotatably support the first gear 911. The first gear 911 includes a driving gear portion 911*a* and a driven gear portion 911*b* that rotate around the same axial line and are integrally formed.

A driven object 914 is fixed to one end portion of the shaft 903 rotatably supported by the slide bearings 904. A motor gear 902 is engaged with the driving gear portion 911*a* of the first gear 911. Rotational driving force of the motor gear 902 is transmitted to the driven object 914 through the first gear 911, the second gear 908, and the shaft 903.

The conditions of the respective elements of the test drive device 920 are illustrated in Table 1.

TABLE 1

| | | First gear | | |
|---|---|---|---|---|
| | Motor gear | Driving gear portion | Driven gear portion | Second gear |
| Material | SUS | POM | POM | POM |
| Number of teeth | 20 | 45 | 37 | 50 |
| Module | | 1.2 | | 1.2 |
| Torsion angle [°] | | 0 | | 0 |
| Addendum modification | 0.65 | 0.7 | 0.15 | 0.05 |
| Sliding ratio | −0.83 | −0.96 | −0.99 | −0.97 |
| Reduction ratio | | 45/20 = 2.25 | | 50/37 = 1.35 |
| Engaging tooth width [mm] | | 12 | | 8 |
| Shaft diameter [mm] | — | ϕ6 | | ϕ6 |
| Slide bearing material | | | | POM |
| Clearance [mm] | | 0.06 | | 0.05 |

POM: Polyoxymethylene, known as polyacetal resin

Next, a grease composition 1 was prepared with the following formulation.

Synthetic oil having viscosity of 24 $mm^2/s$: 74% by weight

Lithium soap: 9% by weight

Polytetrafluoroethylene (PTFE): 3% by weight

Molybdenum disulfide: 2% by weight

Melamine cyanurate: 12% by weight

The consistency (determined by Japanese Industrial Standards (JIS) K2220) of this grease composition 1 was 290.

A grease composition 2 to a grease composition 10 were prepared in accordance with formulations as illustrated in Table 2. When a styrene additive was used for a base grease composition containing base oils and lithium soap, the mixture of the styrene additive uniformly dispersed in the base oils in advance and the base oil and additives were added, and then resulting mixture was stirred so as to prepare a lubricating grease composition.

TABLE 2

| | Grease | | | | | | | | | |
|---|---|---|---|---|---|---|---|---|---|---|
| | 2 | 3 | 4 | 5 | 6 | 7 | 8 | 9 | 10 | 11 |
| Base oil a | 89.6 | 80.8 | 81.3 | 80.4 | 83.7 | 85.0 | — | 42.5 | 91.9 | 89.9– |
| Base oil b | — | — | — | — | — | — | 82.3 | 49.4 | — | — |
| Lithium soap | 4.8 | 4.2 | 3.7 | 4.6 | 3.7 | 5.0 | 7.7 | 3.7 | 3.7 | 1.2 |
| Olefin resin powder | — | 9.4 | 9.4 | 9.4 | 7.0 | 9.4 | 9.4 | — | — | — |
| Styrene additive | 5.0 | 5.0 | 5.0 | 5.0 | 5.0 | — | — | 3.8 | 3.8 | 8.3 |
| Antioxidant | 0.5 | 0.5 | 0.5 | 0.5 | 0.5 | 0.5 | 0.5 | 0.5 | 0.5 | 0.5 |
| Corrosion inhibitor | 0.1 | 0.1 | 0.1 | 0.1 | 0.1 | 0.1 | 0.1 | 0.1 | 0.1 | 0.1 |
| Base oil viscosity [$mm^2/s$] | 18 | 18 | 18 | 18 | 18 | 18 | 9850 | 533 | 18 | 18 |
| *Rate of lithium soap [wt %] | 5.1 | 4.9 | 4.4 | 5.4 | 4.2 | 5.6 | 8.6 | 3.9 | 3.9 | 1.3 |
| Consistency | 394 | 376 | 396 | 361 | 394 | 448 | 358 | 357 | 455 | 402 |

*Li soap/(Hydrocarbon base oil + Li soap)

The specific substances of the respective components illustrated in Table 2 are as follows:

Base oil a: poly-α-olefin (18 $mm^2/s$ at 40° C.)

Base oil b: ethylene-α-olefin oligomer (9850 $mm^2/s$ at 40° C.)

Lithium soap: lithium 12-hydroxystearate

Olefin resin powder: polyethylene powder (average particle diameter of 12 μm)

Styrene additive: hydrogenated styrene-isoprene block copolymer (styrene content of 36% by weight)

Antioxidant: Adekastab QL manufactured by Adeka Corporation. Corrosion inhibitor: Irgamet 39 manufactured by BASF The values of the base oil viscosity, the consistency, and the lithium soap rate in Table 2 were measured by the following manner:

Base oil viscosity: a kinetic viscosity at 40° C. measured in accordance with JIS K 2283.

Consistency: mixture consistency measured in accordance with JIS K 2220.

Lithium soap rate: a rate of the lithium soap weight to the total weight of the base oils and the lithium soap.

In the following description, the experiment condition showing a relatively favorable result is referred to as an "Example", while the experiment condition showing an unfavorable result is referred to as a "Comparation example".

Example 1

No grease composition was applied to the individual parts of the test drive device 920 at all, a motor 901 was rotated at 1200 rpm under an environment of 31° C. and 30% RH. After 60 seconds, a noise generated from the entire device was measured as the noise when no grease composition was applied. Then, the grease composition 3 was applied to each of a third portion P3 and a fourth portion P4 of the test drive device 920. The third portion P3 corresponds to the tooth flank of the driven gear portion 911*b* of the first gear 911 and the tooth flank of the second gear. The fourth portion P4 corresponds to the tooth flank of the motor gear 902 and the tooth flank of the driving gear portion 911*a* of the first gear 911. After the application of the grease composition 3, the motor 901 was rotated at 1200 rpm. After 120 minutes, a noise generated from the entire device was measured. The measurement result was subtracted from the noise when no grease composition was applied. The resulting value was calculated as a noise improvement amount. When the value was negative, the value was not the noise improvement amount but was actually a noise deterioration amount.

Comparison Example 1

The noise improvement amount was calculated in the same manner as Example 1 excect that the grease composition 8 was used instead of the grease composition 3.

Example 2

The specifications of the respective elements of the test drive device 920 were changed to those as indicated in Table 3.

TABLE 3

| | | First gear | | |
|---|---|---|---|---|
| | Motor gear | Driving gear portion | Driven gear portion | Second gear |
| Material | SUS | POM | POM | POM |
| Number of teeth | 13 | 40 | 27 | 36 |
| Module | | 0.4 | | 0.6 |
| Torsion angle [°] | | 16 | | 16 |
| Addendum modification | 0.5 | 0 | 0 | 0 |
| Sliding ratio | −1.5 | −1.8 | −1.5 | −1 |
| Reduction ratio | | 40/13 = 3.08 | | 36/27 = 1.33 |
| Meshing tooth width [mm] | | 12 | | 8 |
| Shaft diameter [mm] | — | | ϕ6 | ϕ6 |
| Slide bearing material | | | | POM |
| Clearance [mm] | | 0.06 | | 0.05 |

No grease composition was applied to the individual parts of the test drive device 920 at all, and the motor 901 was rotated at 2200 rpm under an environment of 31° C. and 30% RH. After 60 seconds, a noise generated from the entire device was measured as the noise when no grease composition was applied.

Then, the grease composition 3 was applied to each of the third portion P3 and the fourth portion P4 of the test drive device 920. Thereafter, the motor 901 was rotated at 2200 rpm and a noise generated from the entire device was measured after 120 minutes. The measurement result was subtracted from the noise when no grease was applied. The resulting value was calculated as the noise improvement amount.

Comparison Example 2

A noise improvement amount was calculated in the same manner as Example 2 except that the grease composition 10 was used instead of the grease composition 3.

Table 4 illustrates the results of the above-mentioned experiments.

TABLE 4

| | Member structure | Grease applied portion: First portion P1 | Second portion P2 | Third portion P3 | Fourth portion P4 | Grease | Noise improvement amount (dB) |
|---|---|---|---|---|---|---|---|
| Example 1 | Table 1 | — | — | ○ | ○ | Grease 3 | 0.6 |
| Example 2 | Table 3 | — | — | ○ | ○ | Grease 3 | 0.9 |
| Comparison example 1 | Table 1 | — | — | ○ | ○ | Grease 10 | 0.1 |
| Comparison example 2 | Table 3 | — | — | ○ | ○ | Grease 8 | 0.2 |

Comparison Example 3

The conditions of the respective members of the test drive device 920 were changed to those as indicated in the following Table 5.

TABLE 5

| | Motor gear | First gear: Driving gear portion | Driven gear portion | Second gear |
|---|---|---|---|---|
| Material | SUS | POM | POM | POM |
| Number of teeth | 13 | 62 | 58 | 70 |
| Module | | 0.4 | | 0.6 |
| Torsion angle [°] | | 16 | | 16 |
| Addendum modification | 0.25 | 0 | 0 | 0 |
| Sliding ratio | −4.8 | −1.5 | −0.6 | −0.5 |
| Reduction ratio | | 62/13 = 4.77 | | 70/58 = 1.21 |
| Engaging tooth width [mm] | | 12 | | 8 |
| Shaft diameter [mm] | — | ϕ6 | | ϕ6 |
| Slide bearing material | | | | POM |
| Clearance [mm] | | 0.06 | | 0.05 |

No grease composition was applied to the individual parts of the test drive device 920 at all, and the motor 901 was rotated at 2400 rpm under an environment of 31° C. and 30% RH. After 60 seconds, a noise generated from the entire device was measured as the noise when the no grease was applied.

Then, the grease composition 1 was applied to each of a second portion P2, the third portion P3, and the fourth portion P4 of the test drive device 920. Thereafter, the motor 901 was rotated at 2400 rpm and a noise generated from the entire device was measured after 180 minutes. The measurement result was subtracted from the noise when no grease was applied. The resulting value was calculated as the noise improvement amount. It should be noted that the second portion P2 corresponds to a portion between the fixing shaft 913 and the inner peripheral surface of a hole of the first gear 911.

Example 3

The noise improvement amount was calculated in the same manner as Comparison example 3 except that the grease composition 6 was used instead of the grease composition 1.

Examples 4 to 6

No grease composition was applied to the individual parts of the test drive device 920 under the conditions of Table 5 (same as those in Example 3) at all, the motor 901 was rotated at 2900 rpm under an environment of 31° C. and 30% RH. After 60 seconds, a noise generated from the entire device was measured as the noise when no grease was applied. Then, each grease composition was applied to each of first portions P1, the second portion P2, the third portion P3, and the fourth portion P4 of the test drive device 920. It should be noted that the first portions P1 correspond to portions between the slide bearings 904 and the shaft 903.

The motor 901 was rotated at 2900 rpm and a noise generated from the entire device was measured after 200 minutes. The measurement result was subtracted from the noise when no grease was applied. The resulting value was calculated as the noise improvement amount. An experiment condition using the grease composition 3 as the grease composition was set to Example 4. An experiment condition using the grease composition 4 as the grease composition was set to Example 5. An experiment condition using the grease composition 5 as the grease composition was set to Example 6.

Comparison Examples 3 to 6

The noise improvement amounts were calculated in the same manner as Examples 4 to 6 except that the used grease compositions were changed. An experiment condition using the grease composition 1 was set to Comparison example 3. An experiment condition using the grease composition 9 was set to Comparison example 4. An experiment condition using the grease composition 11 was set to Comparison example 5. An experiment condition using the grease composition 8 was set to Comparison example 6.

Table 6 illustrates the results of the above-mentioned experiments.

TABLE 6

| | Member structure | Grease application portion: First portion P1 | Second portion P2 | Third portion P3 | Fourth portion P4 | Grease | Noise improvement amount (dB) |
|---|---|---|---|---|---|---|---|
| Example 3 | Table 5 | ○ | — | ○ | ○ | Grease 6 | 1.2 |
| Example 4 | Table 5 | ○ | ○ | ○ | ○ | Grease 3 | 2.8 |
| Example 5 | Table 5 | ○ | ○ | ○ | ○ | Grease 4 | 3.0 |
| Example 6 | Table 5 | ○ | ○ | ○ | ○ | Grease 5 | 2.9 |
| Comparison example 3 | Table 5 | ○ | — | ○ | ○ | Grease 1 | 0.5 |
| Comparison example 4 | Table 5 | ○ | ○ | ○ | ○ | Grease 9 | 0.4 |
| Comparison example 5 | Table 5 | ○ | ○ | ○ | ○ | Grease 11 | 0.5 |
| Comparison example 6 | Table 5 | ○ | ○ | ○ | ○ | Grease 8 | 0.5 |

Examples 7 and 8, Comparison Example 7

IPSiO SP4310 manufactured by Ricoh Company, Ltd. was prepared as an image forming apparatus. No grease composition was applied to a drive device of an image formation unit of the image forming apparatus at all, 1,000 sheets of test images were output under an environment of 31° C. and 30% RH, and a noise generated from the image forming apparatus was measured as the noise when no grease was applied. Then, a grease composition was applied to all portions between slide bearings and shafts, all portions between the inner peripheral surfaces of holes of gears and shafts, and all tooth flanks that are mounted on the drive device of the image formation unit excluding a fixing device in the image forming apparatus. Then, 1,000 sheets of test images were output under an environment of 31° C. and 30% RH, and a noise generated from the image forming apparatus was measured. The measurement result was subtracted from the noise when no grease was applied. The resulting value was calculated as the noise improvement amount. In Example 7 using the grease composition 3, the noise improvement amount was 6.0 dB. In Example 8 using the grease composition 4, the noise improvement amount was 5.9 dB. In Comparison example 7 using the grease composition 2, the noise improvement amount was 2.7 dB.

Thereafter, in Example 7, Example 8, and Comparison example 7, 50,000 sheets of test images were further output and the noise improvement amounts were calculated. The noise improvement amount in Example 7 was 5.9 dB. The noise improvement amount in Example 8 was 5.8 dB. The noise improvement amount in Comparison example 7 was 1.7 dB. Each of them is the noise improvement amount relative to the noise when no grease was applied.

From the above-mentioned experiments, it was understood the following. That is to say, separation of even a soft grease composition from base oil over time is made difficult to occur by using a solid lubricant having a specific gravity close to that of the base oil and having high chemical affinity with the base oil. The solid lubricant is made of polyolefin resin powder. Use of the polyolefin resin powder as the solid lubricant could reduce a noise due to rubbing between the tooth flanks effectively even with the soft grease composition, and could reduce scattering of the grease composition from the tooth flanks effectively. By providing the grease composition between the slide bearings and the shafts passing therethrough and between the inner peripheral surfaces of the holes of the gears and the shafts passing through the holes, a noise due to the rubbing between the slide bearings and the shafts and a noise due to the rubbing between the inner peripheral surfaces of the holes of the gears and the shafts could also be reduced effectively.

The drive device according to the embodiment has the structure same as that of the test drive device 920 as illustrated in FIG. 1. Thus, the drive device in the embodiment transmits rotation energy of a driving motor to a driven object through a plurality of gears to drive the driven object. Belts and pulleys may be provided in addition to the plurality of gears as needed. The number of driven objects is basically one, but may be plural. The drive device according to the embodiment may drive the driven object at an appropriate speed by reducing or increasing the rotational speed of the driving motor through the gears.

The drive device according to the embodiment is a drive device which transmits driving force using a plurality of gears (for example, the second gear 908) and in which a grease composition is applied to a tooth flank of at least one gear of the gears. In the drive device, the gear to which the grease composition is applied is made of a resin, the grease composition contains a hydrocarbon base oil, lithium soap as a thickener, and olefin resin powder, a weight ratio between the hydrocarbon base oil and the lithium soap (hydrocarbon base oil:lithium soap) in the grease composition is adjusted in a range of 94.5:5.5 to 96.0:4.0, and a consistency of the grease composition is adjusted in a range of 360 to 400. Hereinafter, such grease composition can be expressed as a grease composition in the embodiment.

The consistency of the grease composition in the embodiment is in a range of 360 to 400, and preferably a range of 365 to 395. The grease composition having a consistency smaller than 360 is hardly provided uniformly between the slide bearings and the shaft passing therethrough and between the inner peripheral surface of the hole of the gear and the shaft passing through the hole, and thus hardly maintains the fluid oil film pressure uniformly. As a result, the grease composition unfavorably causes a noise to become larger and may reduce the durability of the slide bearings. On the other hand, the grease composition having a consistency larger than 400 may unfavorably behave in the following ways where the clearances between the slide bearings and the shaft passing through them and between the inner peripheral surface of the hole of the gear and the shaft passing through the hole is in a range of 10 to 110 μm. With the progress of the operation of the drive device, the grease composition flows from the clearance to the outside of them, thereby causing the fluid oil film pressure to be difficult to be maintained uniformly. As a result, a noise becomes larger and the durability of the slide bearing, the gears, and the shaft is reduced. In the case of the grease composition having a consistency larger than 400, the grease composition tends to be readily scattered from the tooth flanks of the gears with the progress of the operation of the drive device. As a result, unfavorably, it becomes difficult to maintain an effect of reducing a noise or increasing the durability of the gears over a long period of time in addition to the contamination of the drive device and the peripheral device due to the scattered grease composition. The consistency of the grease composition is a mixing consistency that is measured in accordance with JIS K2220.

In the grease composition according to the embodiment, the ratio of the hydrocarbon base oil (A) to the lithium soap (B) serving as a thickener is in a range of 94.5:5.5 to 96.0:4.0. When the ratio of the amount of the thickener to that of the base oil is larger than the range described above, the grease composition becomes hard and may increase a resistance to stirring. When the ratio of the amount of the thickener to that of the base oil is smaller than the range, the grease composition softens and unfavorably may leak from the clearance.

Any hydrocarbon base oils can be used as the hydrocarbon base oil of the grease composition according to the embodiment regardless of the types of mineral oils and synthetic oils or regardless of being used singly or as a mixture. Examples of the hydrocarbon base oils include mineral oils typified by a paraffin oil and a naphthene-based oil, ester synthetic oils typified by diester and polyol ester, olefin synthetic oils typified by poly-α-olefin, α-olefin oligomer, polybutene, and polyisobutylene, and ester synthetic oils typified by alkylene diphenyl ether and polyalkylene ether. The olefin synthetic oils are preferable that cause relatively little damage on the resin material and have an excellent balance between heat resistance and low temperature property. These base oils can be singly used or as a combination of two or more oils. The kinetic viscosity of the base oil is preferably equal to or smaller than 20 $mm^2/s$ at 40° C. in order to rotate the gears and the shaft smoothly and reduce a noise of the whole of the drive device.

Any lithium soap can be used as the thickener of the grease composition according to the embodiment regardless of being used singly or as a mixture. Examples of the lithium soap include lithium salts of monocarboxylic fatty acid or hydroxy monocarboxylic fatty acid and lithium salts of a vegetable oil such as a seed oil and an animal oil used for manufacturing lithium soap or fatty acids derived from the oils. The lithium salt of monocarboxylic fatty acid or hydroxy monocarboxylic fatty acid is preferable. In particular, the lithium salt of monocarboxylic fatty acid or hydroxy monocarboxylic fatty acid having 8 to 12 carbon atoms is preferable. More specifically, examples of the lithium salt of monocarboxylic fatty acid include the lithium salts of lauric acid, myristic acid, palmitic acid, stearic acid, behenic acid, myristoleic acid, palmitoleic acid, oleic acid, and linoleic acid, while examples of the lithium salt of hydroxy monocarboxylic fatty acid include the lithium salts of 12-hydroxystearic acid, 14-hydroxystearic acid, 16-hydroxystearic acid, 6-hydroxystearic acid, and 9,10-hydroxystearic acid. Furthermore, straight-chain monocarboxylic fatty acid or straight-chain hydroxy monocarboxylic fatty acid, which has an excellent durability with respect to the lubrication portion composed of a metallic member and a resin member, is preferable. More specifically, lithium stearate or lithium 12-hydroxystearate is preferably used.

The grease composition in the embodiment contains, as the solid lubricant, the olefin resin powder that is readily dispersed in a very soft grease composition having the consistency of the range of 360 to 400. With use of the olefin resin powder, contamination of the drive device and the peripheral devices thereof due to scattering of the grease composition from the tooth flanks of the gears and lubrication failure due to absence of the oil film can be prevented. In addition, the shaft passing through the slide bearings and the gear on the peripheral surface of the shaft can be rotated smoothly so as to reduce a noise of the entire drive device and improve the durability. The content of the olefin resin powder is preferably in a range of 1 to 20% by weight with respect to the total grease composition, and more preferably from 5 to 10% by weight. Excessive olefin resin powder may unfavorably increase the rotation resistance of the gears.

To the grease composition according to the embodiment, additives typically mixed may be added besides the hydrocarbon base oil and the lithium soap depending on the intended use. Examples of the additives include a solid lubricant other than olefin resin powder, a thickener, an antioxidant, an extreme-pressure additive, an oily additive, a rust preventive agent, a corrosion inhibitor, a metal deactivator, dyes, a hue stabilizer, a viscosity-index improving agent, and a structure stabilizer.

Any solid lubricants can be used in addition to the olefing resin powder regardless of being used singly or as a mixture. Examples of the solid lubricant include layered compounds typified by melamine cyanurate, molybdenum disulfide, boron nitride, graphite, mica, and graphite fluoride, fluororesins typified by polytetrafluoroethylene (PTFE), tetrafluoroethylene-perfluoroalkylvinylether copolymer (PFA), tetrafluoroethylene-hexafluoropropylene copolymer (FEP), ethylene-tetrafluoroethylene copolymer (ETFE), polyvinylidene difluoride (PVDF), and polychlorotrifuruoroethylene (PCTFE), metal oxides typified by titanium dioxide and zinc oxide, and powder of synthetic resins typified by polyolefin and polyamide.

The grease composition according to the embodiment has a consistency ranging from 360 to 400, which is very soft. Because of the softness, a styrene thickener is preferably used for the purpose of preventing the grease composition from being dripped and scattered from the sliding surfaces of the gears and the shafts, causing the gear having a through hole through which the shaft passes and the shaft passing through the slide bearing to smoothly rotate, reducing a noise generated from the whole of the drive device, and increasing the durability. The content of the styrene thickener is preferably in a range of 1 to 20% by mass with respect to the total mass of the grease composition, and more preferably, 2 to 10% by mass. When an excessively large amount of the styrene thickener is added, the consistency cannot be adjusted in a range of 360 to 400 in a case in which the ratio of the hydrocarbon base oil to the lithium soap is in a range of 94.5:5.5 to 96.0:4.0. As a result, the rotation resistances of the gears may be further increased. When an excessively small amount of the styrene thickener is added, the expected role of the styrene thickener unfavorably may not be achieved. The expected role is to prevent the grease composition from being dripped and scattered from the sliding surfaces of the gears and the shafts, cause the gear and the shaft to smoothly rotate, reduce a noise generated from the whole of the drive device, and increase the durability.

A module of the gears that are used for the drive device in the embodiment is in a range of 0.3 to 1. When the module of the gears is lower than 0.3, the strength of the gears is low and noise due to rubbing of the gears is increased due to variation in positional accuracy when the gears are installed, and it is therefore not preferable. In contrast, when the module of the gears is higher than 1, force acting on the gears is increased and noise tends to be large, and it is therefore not preferable.

When an absolute value of a sliding ratio of each of the gears that are used for the drive device in the embodiment is equal to or larger than 1, the sliding resistance of the tooth flank is increased and noise is increased. When the absolute value is equal to or larger than 4, the sliding resistance of the tooth flank is increased and the increase in noise and rotating accuracy are deteriorated. As a reduction ratio is increased, the sliding ratio tends to be increased, and driving force of the driving motor is transmitted with a large reduction ratio, in general. That is, the sliding ratio tends to be increased with meshing of the gears attached to the driving motor. In view of this, the grease composition is applied to the tooth flanks of the gears so as to largely reduce noise that is generated due to rubbing between the tooth flanks of the gears.

The gears that are engaged with each other have different sliding ratios in some cases. These values are defined as the sliding ratio and a mating sliding ratio.

The sliding ratio can be calculated by an equation of "sliding ratio=$(q_2 \times Z_1 - q_1 \times Z_2)/q_2 \times Z_1)$".

The mating sliding ratio can be calculated by an equation of "mating sliding ratio=$(q_1 \times Z_2 - q_2 \times Z_1)/(q_1 \times Z_2)$". In these equations, $Z_2$ is the number of teeth. $Z_1$ is the number of teeth of the counterpart.

$q_2$ is calculated by an equation of "$q_2=((da_2/2)^2-(db_2/2)^2)^{0.5}-ga$".

$q_1$ is calculated by an equation of "$q_1=((da_1/2)^2-(db_1/2)^2)^{0.5}$".

In these equations, $da_1$ is a tooth tip diameter. $db_2$ is a pitch circle diameter. $da_1$ is a tooth tip diameter of the counterpart. $db_1$ is a pitch circle diameter of the counterpart.

ga in the equation for calculating $q_2$ is calculated by the following equation.

$$\text{“}ga=((da_1/2)^2-(db_1/2)^2)^{0.5}+((da_2/2)^2-(db_2/2)^2)^{0.5}-A\times \sin(CS)\text{”}.$$

A in this equation is a distance between the shafts.

CS in this equation is calculated by the following equation.

$$\text{“}CS=A\mathrm{INV}(2\times(X_2+X_1)/(Z_2+Z_1)\times\tan(\pi\times\alpha/180)+\tan(\alpha t)-\alpha t)\text{”}.$$

$X_2$ in this equation is an addendum modification coefficient. $X_1$ is an addendum modification coefficient of the counterpart. $\alpha$ is a pressure angle. $\alpha t$ is a transverse pressure angle. AINV is an operator of an involute inverse function.

The involute inverse function is expressed by "$\mathrm{INV}(X)=\tan X-\pi X/180$".

The drive device in the embodiment includes, as the gears, the gear that is fixed to the shaft passing through the slide bearings and rotates together with the shaft, and the gear that has the through-hole and rotates on the fixing shaft in a state where the fixing shaft is inserted into the through-hole. The grease composition in the embodiment is also held between the slide bearings and the shaft passing through them in addition to the tooth flanks preferably. The grease composition in the embodiment has a high consistency so as to effectively reduce noise by making friction between the rotating shaft and the slide bearings receiving the shaft be flow friction.

The gear that is fixed to the shaft passing through the slide bearing and rotates with the shaft can be fixed to the shaft with a setscrew, a taper joint, a key joint, a spline joint, or a friction joint, for example. The gear may be formed by being integrated with the shaft. The shaft rotates with the gear while passing through the slide bearing and being supported by the slide bearing. Known examples of the bearing include a slide bearing, a ball bearing, and a roller bearing. The drive device according to the present invention includes at least the slide bearing, and the shaft passing through the slide bearing and the gear fixed to the shaft. The slide bearing, the structure of which is simpler than those of other bearings, has an advantage of being used for manufacturing a compact drive device because of its low manufacturing cost, light weight, and compact size.

The drive device according to the embodiment includes at least one set of the slide bearing and the shaft passing through the slide bearing, and at least one of the slide bearing and the shaft is made of a resin. At least one of the slide bearing and the shaft passing through the slide bearing is made of a resin that achieves a light weight and has an excellent workability, thereby making it possible to provide a compact, lightweight, and low cost drive device.

Any metallic materials and resin materials can be used as the material for the slide bearing used in the drive device according to the embodiment. In view of a lightweight property and cost, resin materials are preferably used. Examples of the resin materials used for the slide bearing include a fluororesin, a polyacetal resin, a polyphenylene sulfide resin, and a polyether ether ketone resin. In view of durability and cost, the polyacetal resin is most preferred.

Any metallic materials and resin materials can be used for the material of the shaft passing through the slide bearing used in the drive device according to the embodiment. A metallic material is preferably used for the shaft that rotates at a high speed and receives high torque, while a resin material is preferably used for the shaft that rotates at a low speed and receives low torque. Examples of the metallic materials that can be used for the shaft passing through the slide bearing include alloys and various metals. In view of durability, workability, and cost, the metallic material is preferably a stainless steel or a free-cutting steel. Examples of the resin materials that can be used for the shaft passing through the slide bearing include a fluororesin, a polyacetal resin, a polyphenylene sulfide resin, and a polyether ether ketone resin. In view of durability and cost, the polyacetal resin is the most preferable.

The clearance between the slide bearing used in the drive device according to the embodiment and the shaft passing through the slide bearing is in a range of 10 to 110 μm, preferably 20 to 100 μm, and more preferably 25 to 90 μm. When the clearance between the slide bearing and the shaft is smaller than 10 μm, the slide bearing or the shaft is readily damaged due to the contact therebetween in the assembly and in being driven, thereby causing the rotation of the shaft to be unstable. As a result, unfavorably, a noise becomes large and the durability of the slide bearing or the shaft is reduced. In particular, when one of the slide bearing and the shaft is made of a metallic material while the other is made of a resin material, the influence of the noise is markedly increased. When the clearance between the slide bearing and the shaft is larger than 110 μm, the shaft rotates unstably due to the poor fixation of the shaft. As a result, unfavorably, a noise becomes large and the durability of the slide bearing or the shaft is reduced.

Preferably, the grease composition in the embodiment is also provided between the inner peripheral surface of the hole of the gear rotating on the peripheral surface of the shaft and the shaft passing through the hole that are used for the drive device in the embodiment. The grease composition in the embodiment has a high consistency so as to reduce generation of noise to be extremely small by making friction between the inner peripheral surface of the hole of the gear and the shaft passing through the hole be flow friction.

The gear and the shaft that are used for the drive device in the embodiment are made of resin or a metal as for the set of the inner peripheral surface of the hole of the gear rotating on the peripheral surface of the shaft and the shaft passing through the hole. The drive device in the embodiment includes at least one set of the gear and the shaft at least one of which is made of resin. One of the gear and the shaft is made of resin that is lightweight and is excellent in processability so as to reduce the drive device in size, weight, and cost.

The shaft passing through the hole of the gear that is used for the drive device in the embodiment can be made of any of a metal and resin. The shaft made of the metal is preferably used in order to provide necessary strength for maintaining smooth rotation of the gear while receiving force acting on the gear. Particularly preferably, the shaft made of stainless steel or free-cutting steel is used in consideration of durability, processability, and cost.

The gear rotating on the peripheral surface of the shaft passing through the hole thereof that is used for the drive device in the embodiment can be made of any of a metal and resin. The gear is preferably made of the resin material in consideration of lightweight property and cost. Examples of the resin material include fluororesin, polyacetal resin, polyphenylene sulfide resin, and polyether ether ketone resin. In consideration of durability and cost, polyacetal resin is the most preferable.

In the drive device in the embodiment, the clearance between the inner peripheral surface of the hole of the gear and the shaft passing through the hole is in a range of 10 to 110 μm, preferably a range of 20 to 100 μm, and more preferably a range of 25 to 90 μm. When the clearance is smaller than 10 μm, the inner peripheral surface of the hole of the gear makes contact with the shaft and is easy to be scratched at the time of assembly and driving, rotation of the gear is unstable, noise is increased, and durability of the gear is lowered. For this reason, it is not preferable. In contrast, when the clearance is larger than 110 μm, rotation of the gear is unstable, noise is increased, and durability of the gear is lowered. For this reason, it is also not preferable.

The drive device according to the embodiment generates few noises and has an excellent durability, thereby making it possible to be mounted on various apparatuses. Examples of the various apparatuses include apparatuses operating in quiet offices or closed spaces or in quiet environments such as in a midnight environment, and apparatuses operating just near people. In particular, the drive device can be preferably used for image forming apparatuses (e.g., printers, facsimiles, copying machines, and multifunctional peripherals) using a heat transfer technique, a thermal technique, an inkjet technique, or an electrophotographic technique, for example, because of the following reasons. Such image forming apparatuses are widely used in homes and offices. With the progress of downsizing of the image forming apparatuses, they are installed just near users. As a result, the reduction of noises is strongly required.

At the portion in which the grease composition according to the embodiment is provided, a friction coefficient between resins, a friction coefficient between a resin and a metal or an alloy, or a friction coefficient between a metal or an alloy and a metal or an alloy is preferably small over a long period. The friction coefficient in the embodiment is equal to or smaller than 0.15, preferably equal to or smaller than 0.13, and more preferably in a range of 0.01 to 0.12. The friction coefficient is measured in a range of 10 to 2000 cycles in a test in which a ball with a ½-inch diameter is slid on a plate on which a certain grease composition is applied using a reciprocating tester. In the measurement of the friction coefficient using the reciprocating tester, the measurement values of the friction coefficient can be unstable depending on the application state of the grease composition at an initial stage of the cycle (smaller than 10 cycles) in some cases. It is, thus, important that the friction coefficient is measured in a range of 10 to 2000 cycles, in which case the grease composition is in a stable application state.

Figure 3:
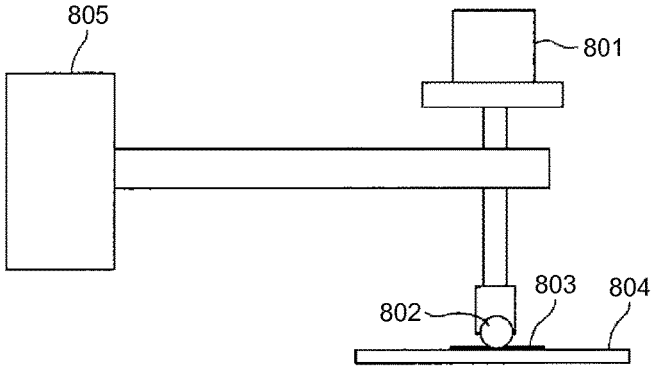
FIG. 3 is a schematic structural diagram illustrating a device used for measuring a friction coefficient.

The friction coefficient of the grease composition according to the embodiment is small over a long period. The grease composition, thus, greatly contributes to the improvement of the reliability of the drive device. For reference, the friction coefficients of the grease composition used in Example 9 (the grease composition 3 used in Example 1 was used) and the grease compositions conventionally used for the drive devices of the image forming apparatus were measured using the device illustrated in FIG. 3. As illustrated in FIG. 3, the device is provided with a weight 801, a nylon 66 ball 802 with a ½-inch diameter (product name: AMILAN CM3001-N), and a load cell 805, for example. As for the conventionally used grease compositions, those in Comparative example 8 (containing olefin oil, lithium soap, PTFE, and melamine cyanurate, and the consistency was 333), Comparative example 9 (containing dimethyl silicone oil and lithium soap, and the consistency was 357), Comparative example 10 (containing perfluoroether oil and PTFE, and the consistency was 250), and Comparative example 11 (containing olefin oil and urea, and the consistency is 262) were used. The measurement was carried out as follows. Each of the grease compositions (a grease composition 803 illustrated in FIG. 3) was applied on a POM plate (DURACON SW-01) 804 with a thickness of 0.1 mm. The friction coefficient was measured when the nylon 66 ball 802 with a ½-inch diameter (product name: AMILAN CM3001-N) was slid under the conditions in which a load was 0.49 N, a sliding speed was 60 cpm, and a sliding distance was 40 mm.

Figure 4:
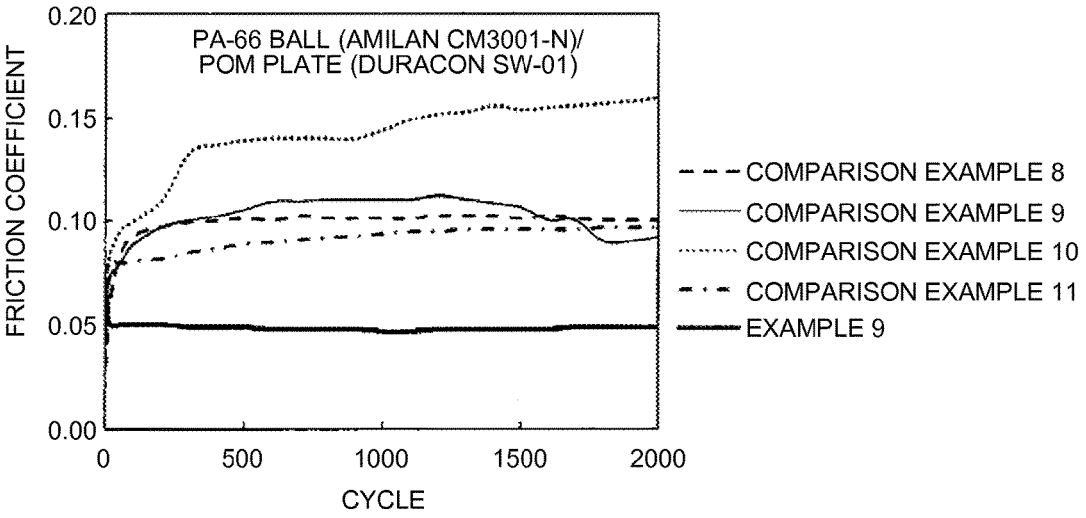
FIG. 4 is a graph illustrating a relation among types of greases, friction coefficients, and the number of friction cycles in a first test.

FIG. 4 is a graph illustrating the measurement results of the friction coefficients. As illustrated in FIG. 4, the grease composition in Example 9 has a smaller friction coefficient than the friction coefficients of those in Comparative examples 8, 9, 10, and 11, which are conventionally used. The friction coefficient of the grease composition in Example 19 is less fluctuated and stable over the friction cycles.

Figure 5:
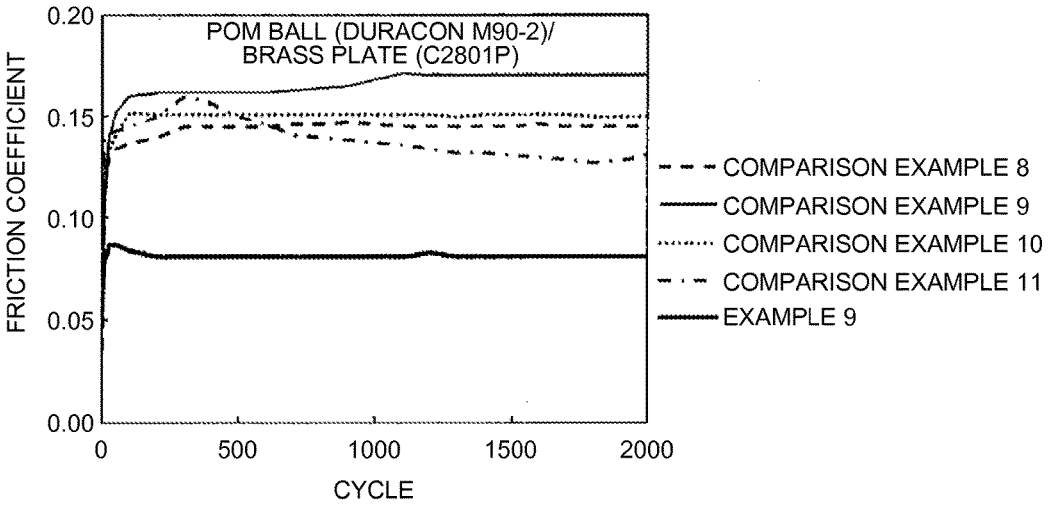
FIG. 5 is a graph illustrating a relation among types of greases, friction coefficients, and the number of friction cycles in a second test.

Then, the friction coefficients were measured in the same manner as described above except that a brass plate (C2801P) was used instead of the POM plate (DURACON SW-01) 804, and a POM ball (DURACON M90-02) was used instead of the nylon 66 ball 802 with a ½-inch diameter (AMILAN CM3001-N). FIG. 5 is a graph illustrating the measurement results of the friction coefficients. As illustrated in FIG. 5, the grease composition in Example 9 has a smaller friction coefficient than the friction coefficients of those in Comparative examples 8, 9, 10, and 11, which are conventionally used. The friction coefficient of the grease composition in Example 9 is less fluctuated and stable over the friction cycles.

Figure 6:
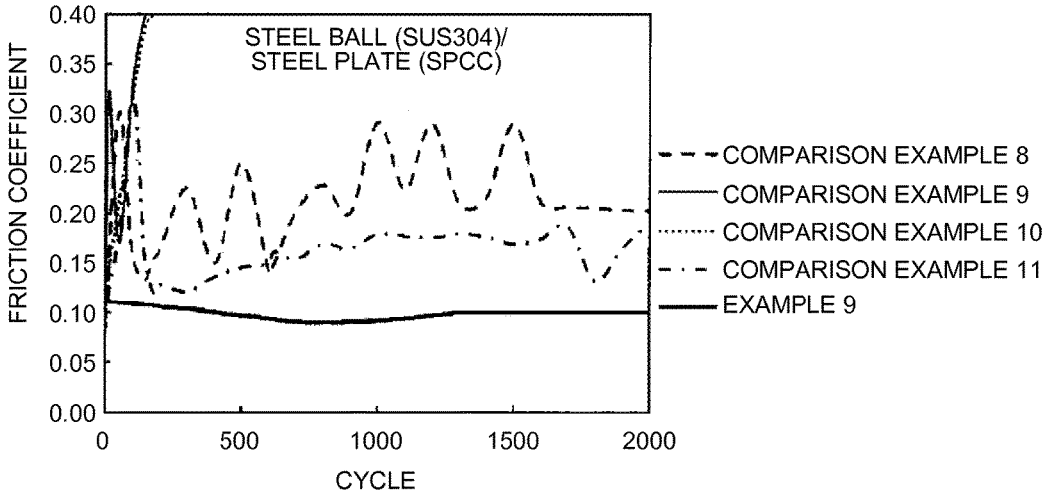
FIG. 6 is a graph illustrating a relation among types of greases, friction coefficients, and the number of friction cycles in a third test.

The friction coefficients were measured in the same manner as described above except that a steel plate (SPCC) was used instead of the POM plate (DURACON SW-01) 804 and a steel ball (SUS 304, which is a stainless steel) was used instead of the nylon 66 ball 802 with a ½-inch diameter (AMILAN CM3001-N). FIG. 6 is a graph illustrating the measurement results of the friction coefficients. As illustrated in FIG. 6, the grease composition in Example 9 has a smaller friction coefficient than the friction coefficients of those in Comparative examples 8, 9, 10, and 11, which are conventionally used. The friction coefficient of the grease composition in Example 9 is less fluctuated and stable over the friction cycles.

The grease composition according to the embodiment has excellent storage conservation. In particular, the grease composition using the styrene thickener according to the embodiment has a very small oil separation degree measured in accordance with JIS K2220. The oil separation degree can be reduced to equal to or smaller than 0.2%, preferably equal to or smaller than 0.15%, and more preferably equal to or smaller than 0.1%. In this way, the grease composition according to the embodiment has excellent storage conservation and stability. The grease composition using the styrene thickener according to the embodiment greatly contributes to the improvement of the reliability of the drive device.

Figure 7:
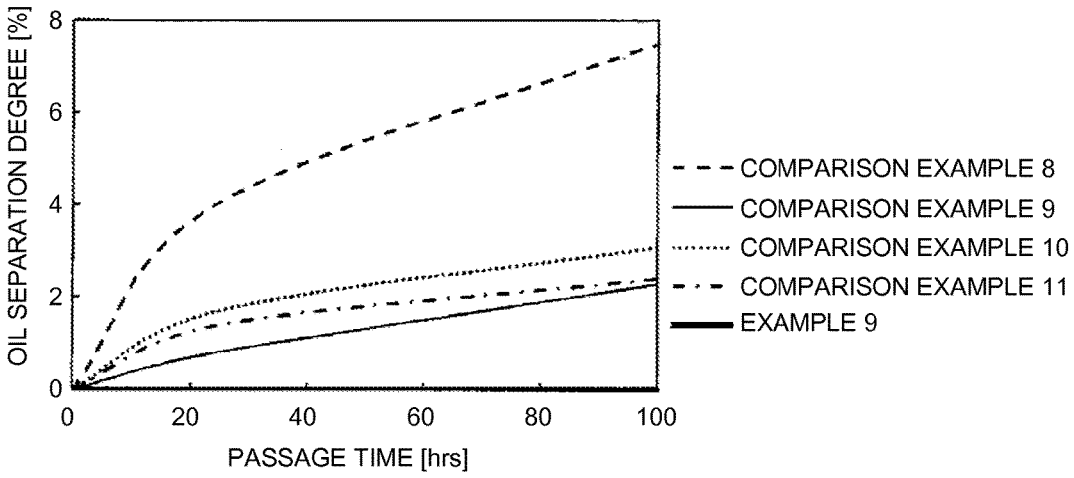
FIG. 7 is a graph illustrating a relation among types of greases, oil separation degrees, and elapsed time in a fourth test.

For reference, aging of the oil separation degrees of the grease composition according to the embodiment (that in Example 9) and the grease compositions in Comparative examples 8, 9, 10, and 11 was measured. Specifically, the aging of the oil separation degrees was measured by an oil separation degree measurement method in accordance with JIS K2220 at 100° C. for 100 hours. FIG. 7 is a graph illustrating the measurement results of the aging. The grease composition in Example 9 has a smaller aging change in oil separation degree than the aging changes in oil separation degree of those in Comparation examples 8, 9, 10, and 11. The oil separation degree of the grease composition in Example 9 does not change at 100° C. for 100 hours practically. The grease composition in Example 9 thus has excellent storage conservation and stability.

The following describes an image forming apparatus, on which the multiple drive devices according to the present invention are mounted, according to the embodiment. The image forming apparatus, which can demonstrate an exceptional effect of reducing a noise, according to the embodiment is an example of the image forming apparatus according to the present invention. The image forming apparatus according to the present invention is not limited to the image forming apparatus according to the embodiment.

Figure 2:
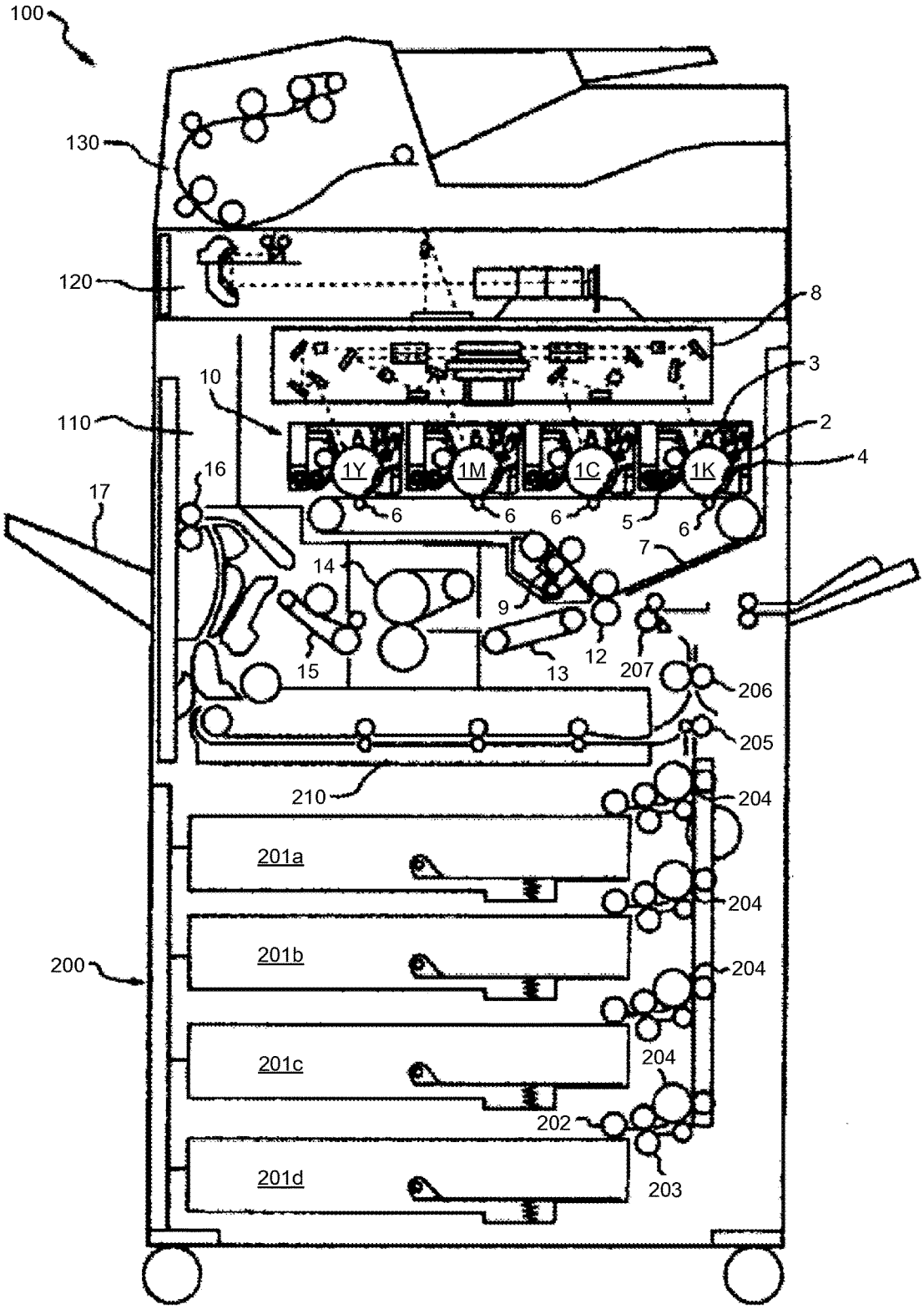
FIG. 2 is a schematic structural diagram illustrating an image forming apparatus according to the embodiment.

FIG. 2 is a schematic structural diagram illustrating an image forming apparatus 100 according to the embodiment. The image forming apparatus 100 includes a body (printer unit) 110 that performs image formation, a document reader (scanner unit) 120 that is provided above the body 110, an automatic document feeder (ADF) 130 provided above the document reader 120, and a paper feeding unit 200 provided under the body 110, and has a function of a copying machine. The image forming apparatus 100 has a function to communicate with external apparatuses. The image forming apparatus 100 can be used as a printer or a scanner by being connected to an external apparatus such as a personal computer. In addition, the image forming apparatus 100 can be used as a facsimile by being connected to a telephone line or an optical communication line.

In the body 110, four image forming units (image forming stations) 10 are disposed side by side. The image forming units 10 have the same structure and use different toner colors from each other. The four image forming units 10 form different color toner images from each other using toner of the respective different colors (e.g., yellow (Y), magenta (M), cyan (C), and black (K)). Color toner images are transferred onto an intermediate transfer medium 7 to overlap one another, thereby making it possible to form a multi-color or full color image.

The four image forming units 10 are disposed side by side along the intermediate transfer medium 7 that has a belt shape and is stretched by a plurality of rollers. The respective color toner images formed by the image forming units 10 are sequentially transferred onto the intermediate transfer medium 7 to overlap one another. Thereafter, the overlapped toner images are transferred at once by a secondary transfer device 12 onto a transfer medium having a sheet shape such as paper.

The four image forming units 10 each include, around respective drum-shaped photoconductors 1 (1Y, 1M, 1C, and 1K), a protective agent application device 2, a charging device 3, an exposure unit that guides writing light (e.g., laser light) emitted from a latent image forming device 8 to the corresponding photoconductor 1, a developing device 5, a primary transfer device 6, and a cleaning device 4. The image forming units 10 for the respective colors each have a process cartridge that houses the photoconductor 1, the protective agent application device 2 (including the cleaning device 4), the charging device 3, and the developing device 5 in a common cartridge. The process cartridges are attached to the body 110 in a detachable manner.

The following describes the operation of the image forming apparatus 100. A series of processes for image forming is described in a negative-positive process as an example. The four image forming units 10 operate in the same manner, and the operation of one of the image forming units 10 is described as an example.

The drum-shaped photoconductor 1, which is an image bearer typified by an organic photo conductor (OPC) having an organic photoconductive layer, is neutralized by a discharge lamp (not illustrated), for example, and thereafter is uniformly charged to a minus polarity by the charging device 3 having a charging member (e.g., a charging roller). When the photoconductor 1 is charged by the charging device 3, a charging voltage appropriate for charging the photoconductor 1 to a desired potential is applied to the charging member from a voltage applying mechanism (not illustrated). The charging voltage has an appropriate magnitude or is the voltage in which an alternating voltage is superimposed on the voltage.

The charged photoconductor 1 is optically scanned by laser light emitted from the latent image forming device 8 employing a laser scanning technique. The latent image forming device 8 includes a plurality of laser light sources, a coupling optical system, a light deflector, and a scanning imaging forming optical system, for example. The area exposed by the optical scanning in the entire surface of the photoconductor 1 forms an electrostatic latent image (the absolute value of the potential of the exposed area is smaller than the absolute value of the potential of the unexposed area). Laser light emitted from the laser light source (e.g., a semiconductor laser) is deflected by the light deflector including a polygon mirror having a polygonal shape and rotating at a high speed for scanning, and scans the surface of the photoconductor 1 in a rotational axis direction (main-scanning direction) of the photoconductor 1 through the scanning imaging forming optical system including a scanning lens and mirrors.

The latent image thus formed on the surface of the photoconductor 1 is developed with toner particles or a developer including a mixture of toner particles and carrier particles carried on a developing sleeve of a developing roller 51 serving as a developer bearer of the developing device 5. As a result, a toner image is formed. When the latent image is being developed, a developing bias is applied to the developing sleeve of the developing device 51 from the voltage applying mechanism (not illustrated). The developing bias is a voltage having an appropriate magnitude the value of which is between those of the exposed area and the unexposed area of the photoconductor 1 or a bias in which an alternating voltage is superimposed on the voltage.

The toner images formed on the respective photoconductors 1 of the image forming units 10 for respective colors are sequentially primarily transferred onto the intermediate transfer medium 7 to overlap one another by the primary transfer device 6 including transfer rollers. In synchronization with the image forming operation and the primary transfer operation, any one cassette is selected out of paper feeding cassettes 201*a*, 201*b*, 201*c*, and 201*d*, which are arranged in multiple steps in the paper feeding unit 200. From the selected paper feeding cassette, a transfer medium having a sheet shape such as paper is fed by a paper feeding mechanism including a paper feeding roller 202 and separation rollers 203, and conveyed to a secondary transfer unit through conveyance rollers 204, 205, and 206, and registration rollers 207.

In the secondary transfer unit, the toner image on the intermediate transfer medium 7 is secondarily transferred onto the transfer medium conveyed to the second transfer unit by a secondary transfer device (e.g., secondary transfer rollers) 12. In the transfer process, a potential having the polarity opposite to the polarity of the charged toner is preferably applied to the primary transfer device 6 and the secondary transfer device 12 as a transfer bias.

After passing through the secondary transfer unit, the transfer medium is separated from the intermediate transfer medium 7. Toner particles remaining on the photoconductor 1 after the primary transfer is collected by a cleaning member 41 of the cleaning device 4 into a toner collection chamber in the cleaning device 4. Toner particles remaining on the intermediate transfer medium 7 after the secondary transfer are collected by a cleaning member of a belt cleaning device 9 into a toner collection chamber in the belt cleaning device 9.

The image forming apparatus 100 has what is called a tandem structure, in which the multiple image forming units 10 for the respective colors are disposed along the intermediate transfer medium 7, and forms an image on the transfer medium by an intermediate transfer technique. As already described above, the toner images of different colors from each other formed on the respective photoconductors 1 (1Y, 1M, 1C, and 1K) of the image forming units 10 for respective colors are sequentially transferred onto the intermediate transfer medium 7 to overlap one another, and thereafter the overlapped toner images are transferred at once onto the transfer medium such as transfer paper. The transfer medium after the transfer is conveyed by a conveyance device 13 to a fixing device 14, in which the toner images are fixed on the transfer medium by heat, for example. After passing through the fixing device 14, the transfer medium is ejected by the conveyance device 15 and paper ejection rollers 16 into a paper ejection tray 17.

The image forming apparatus 100 has a both-side printing function. In both-side printing, the transfer medium only on one surface of which an image is fixed is conveyed to a conveyance device 210 for both-side printing by changing a conveyance path downstream from the fixing device 14. The conveyance device 210 for both-side printing inverts the front and rear surfaces of the transfer medium. Thereafter, the transfer medium is conveyed to the second transfer unit again by the conveyance rollers 206 and the registration rollers 207. The secondary transfer unit secondarily transfers an image onto the rear surface (the other surface) of the transfer medium. Thereafter, the transfer medium is conveyed to the fixing device 14 again. The fixing device 14 fixes the image on the rear surface of the transfer medium. Then, the transfer medium is conveyed to the paper ejection tray 17 so as to be ejected outside the image forming apparatus.

Instead of the tandem intermediate transfer system, a tandem direct transfer system may be employed. In this case, a transfer belt or the like that carries and conveys the transfer medium is used instead of the intermediate transfer medium 7. The toner images of different colors from each other sequentially formed on the respective photoconductors 1 (1Y, 1M, 1C, and 1K) of the four image forming units 10 are transferred onto the transfer medium on the transfer belt to directly overlap one another. The transfer medium is, then, conveyed to the fixing device 14, in which an image is fixed on the transfer medium by heat, for example.

The image forming apparatus thus structured includes a plurality of drive devices each of which individually drive the photoconductor 1, the cleaning device 4, and the developing device 5, the primary transfer device 6, the driving rollers that endlessly convey the intermediate transfer medium 7 while stretching it, and various conveyance rollers. The drive device according to the embodiment is employed as at least one of the multiple drive devices. In the fixing device 14, in which heat is generated, a different drive device from the drive device according to the embodiment is used because the grease softened by heat may flow out, for example.

The above descriptions are represented by way of example. The present invention also has particular advantages in the following aspects.

Aspect A

Aspect A provides a drive device that includes a plurality of gears and a grease composition that is held on a tooth flank of at least one gear of the gears. The at least one gear is made of a resin. The grease composition contains a hydrocarbon base oil, lithium soap serving as a thickener, and olefin resin powder. A weight ratio between the hydrocarbon base oil and the lithium soap in the grease composition is in a range of 94.5:5.5 to 96.0:4.0. A consistency of the grease composition is in a range of 360 to 400.

In this structure, generation of noise due to rubbing between the tooth flanks of the gears can be prevented by the grease composition. The grease composition is provided between the slide bearings and the shaft passing therethrough and between the inner peripheral surface of the hole of the gear and the shaft passing through the hole so as to reduce noise due to rubbing between the slide bearings and the shaft and noise due to rubbing between the inner peripheral surface of the hole of the gear and the shaft. The grease composition that is held on the tooth flanks and the grease composition that is provided between the slide bearings and the shaft passing therethrough and between the inner peripheral surface of the hole of the gear and the shaft passing through the hole can be made the same, thereby eliminating the necessity to use different compositions. This can prevent the lowering of productivity of the device when a noise due to rubbing between the slide bearings and the shaft passing therethrough and a noise due to rubbing between the inner peripheral surface of the hole of the gear and the shaft passing through the hole are reduced.

Aspect B

Aspect B provides the drive device according to Aspect A, wherein a kinetic viscosity of the hydrocarbon base oil is equal to or lower than 20 $mm^2/s$ at 40° C. In this structure, the consistency of the grease composition can has an appropriate value, thereby effectively reducing the generation of a noise.

Aspect C

Aspect C provides the drive device according to Aspect A or B, wherein the grease composition contains a styrene thickener. In this structure, the styrene thickener contained in the grease composition prevents oil separation from occurring in the grease composition. This structure can effectively reduce the occurrence of a noise with high reliability.

Aspect D

Aspect D provides the drive device according to any one of Aspects A to C, wherein the at least one gear is made of a polyacetal resin. In this structure, a polyacetal resin is used for the gear rotating on the peripheral surface of the shaft so as to effectively reduce the occurrence of a noise while a light weight and a low production cost are achieved.

Aspect E

Aspect E provides the drive device according to any one of Aspects A to D, wherein a module of each of the gears is in a range of 0.3 to 1. In this structure, force acting on the gears can be weakened with reduced variation when the gears are installed, thereby effectively reducing the occurrence of a noise.

Aspect F

Aspect F provides the drive device according to any one of Aspects A to E, wherein an absolute value of a sliding ratio between gears of all of sets of gears that are engaged with each other is equal to or larger than 1. In this structure, sliding resistance between the tooth flanks can be made small, thereby effectively reducing the occurrence of a noise.

Aspect G

Aspect G provides the drive device according to any one of Aspects A to F, wherein a reduction ratio between gears of all of sets of gears that are engaged with each other is equal to or larger than 4 and an absolute value of a sliding ratio between the gears of all of the sets of gears is equal to or larger than 4. In this structure, sliding resistance between the tooth flanks can be made small, thereby effectively reducing the occurrence of a noise.

Aspect H

Aspect H provides the drive device according to any one of Aspects A to G, wherein at least one gear of the gears is arranged so as to rotate on a peripheral surface of a shaft that passes through a hole of the at least one gear, a grease composition is held in a clearance between the hole and the shaft, the grease composition contains a hydrocarbon base oil, lithium soap serving as a thickener, and olefin resin powder, a weight ratio between the hydrocarbon base oil and the lithium soap in the grease composition is in a range of 94.5:5.5 to 96.0:4.0, and a consistency of the grease composition is in to a range of 360 to 400. This structure can effectively reduce, the occurrence of a noise due to rubbing between the inner peripheral surface of the hole of the gear and the shaft passing through the hole.

Aspect I

Aspect I provides an image forming apparatus that includes the drive device according to any one of Aspects A to H. This structure can effectively reduce the occurrence of a noise from the drive device.

Aspect J

Aspect J provides a grease composition used for the drive device according to any one of claims 1 to 8. In this structure, the grease composition can effectively reduce the occurrence of a noise from the drive device.

According to the invention, the lowering of productivity of the device can be prevented in the case where a noise due to rubbing between the slide bearing and the shaft and a noise due to rubbing between the inner peripheral surface of the hole of the gear and the shaft passing through the hole are reduced while generation of a noise due to rubbing between the tooth flanks of the gears is reduced by the grease composition.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

REFERENCE SIGNS LIST

7: intermediate transfer medium
10: image forming unit
100: image forming apparatus
110: body
120: document reader
130: ADF
903: shaft
904: slide bearing
908: second gear
911: first gear

What is claimed is:

1. A drive device comprising:
a plurality of gears; and
a grease composition on a tooth flank of at least one of the plurality of gears, wherein
the at least one of the plurality of gears includes a resin,
the grease composition contains a hydrocarbon base oil, lithium soap serving as a thickener, and a solid lubricant including olefin resin powder,
a weight ratio between the hydrocarbon base oil and the lithium soap in the grease composition is in a range of 94.5:5.5 to 96.0:4.0, and
a consistency of the grease composition is in a range of 360 to 400.

2. The drive device according to claim 1, wherein a kinetic viscosity of the hydrocarbon base oil is equal to or smaller than 20 $mm^2/s$ at 40° C.

3. The drive device according to claim 1, wherein the grease composition includes a styrene thickener.

4. The drive device according to claim 1, wherein the at least one of the plurality of gears includes a polyacetal resin.

5. The drive device according to claim 1, wherein a module of each of the gears is in a range of 0.3 to 1.

6. The drive device according to claim 1, wherein an absolute value of a sliding ratio between gears that are engaged with each other is equal to or larger than 1.

7. The drive device according to claim 1, wherein a reduction ratio between gears that are engaged with each other is equal to or larger than 4, and an absolute value of a sliding ratio between the gears is equal to or larger than 4.

8. An image forming apparatus comprising the drive device according to claim 1.

9. A grease composition included in the drive device according to claim 1.

10. The drive device according to claim 1, wherein the grease composition includes olefin resin powder that is a polyethylene powder.

11. The drive device according to claim 1, wherein the grease composition includes olefin resin powder that is substantially insoluble in the base oil.

12. The drive device according to claim 1, wherein the grease composition includes olefin resin powder that is dispersed in the base oil as solid particles.

* * * * *